US005083667A

United States Patent [19]

Holder

[11] Patent Number: 5,083,667

[45] Date of Patent: Jan. 28, 1992

[54] EASY-OPEN, RECLOSABLE ARTICLE CASE

[75] Inventor: Kathleen Holder, Mt. Holly, N.J.

[73] Assignee: Kraft General Foods, Inc., Glenview, Ill.

[21] Appl. No.: 429,898

[22] Filed: Oct. 31, 1989

[51] Int. Cl.[5] ..... B65B 5/54; B65B 77/30; B65B 75/62

[52] U.S. Cl. ..... 229/229; 229/237; 229/131.1; 229/924

[58] Field of Search ..... 206/607, 608, 611, 614, 206/621, 626, 628

[56] References Cited

U.S. PATENT DOCUMENTS

| | | | |
|---|---|---|---|
| 1,303,138 | 5/1919 | Woolwine | 206/626 |
| 1,980,851 | 11/1934 | Crawford | 206/626 |
| 1,985,590 | 12/1934 | Weiss | 206/626 |
| 1,997,009 | 4/1935 | Nemoede | 206/626 X |
| 2,051,561 | 8/1936 | Lindblow | 206/626 X |
| 2,336,088 | 12/1943 | Goodyear et al. | 206/614 X |
| 2,712,894 | 2/1955 | Paxton | 229/44 |
| 3,142,432 | 12/1964 | Davis | 229/38 |
| 3,243,098 | 3/1966 | Jacke | 206/626 X |
| 3,246,825 | 4/1966 | Zastrow | 206/621 X |
| 3,262,632 | 7/1966 | Brady et al. | 206/621 |
| 3,286,830 | 9/1966 | Robb | 206/56 |
| 3,306,437 | 2/1967 | Nelson | 206/614 X |
| 4,398,636 | 11/1983 | Baxter | 206/614 |
| 4,417,661 | 3/1983 | Roccaforte | 206/625 |

FOREIGN PATENT DOCUMENTS

| | | | |
|---|---|---|---|
| 1471277 | 1/1967 | France | 206/626 |

*Primary Examiner*—Paul T. Sewell
*Assistant Examiner*—Jacob K. Ackur, Jr.
*Attorney, Agent, or Firm*—Thomas R. Savoie

[57] ABSTRACT

A reclosable article case has a main portion which receives a plurality of articles and a closed top comprising inner closure flaps and outer closure flaps. One or more of the outer closure flaps include a tearback tab formed by weakened lines. A base portion of this tearback tab lies immediately over some of the articles in the case while an outer portion of this tearback tab overlies an inner closure flap. Tearing back the tearback tabs provide direct access to at least a portion of the upper parts of all articles within the case for purposes of marking same with tickets or the like. The tearback tabs are then unfolded back to their original flat state, and then tucked underneath an edge of the inner closure flap over which each previously overlied, thus reclosing the article case.

12 Claims, 5 Drawing Sheets

EASY-OPEN, RECLOSABLE ARTICLE CASE

FIELD OF THE INVENTION

This invention relates to article cases, and in particular it relates to a new and improved article case which can be easily opened for temporary access to the contents thereof, then easily reclosed for further handling, shipment or the like.

BACKGROUND OF THE INVENTION

Article cases, also referred to as cartons, boxes or the like are used to contain a plurality of smaller articles such as cans, boxes, etc., for handling and shipment in commerce, for example from an original manufacturer or other original packager through various channels of commerce to a retailer who will generally remove the articles from the case for sale to the ultimate consumer.

Generally, when cases of this type are filled they are permanently closed. Then the retailer or the like whose task it is to open the case for distribution of the plurality of smaller articles will by necessity open at least the closure portion of the case. Since these types of cases generally are not easy to open, it is generally necessary to destroy the closure portion, after which it is not possible to reclose the case to secure the articles nearly as well as the original closure portion.

For example, a typical article case made of corrugated cardboard generally comprises inner and outer closure flaps which are glued together to permanently close the case. The retailer or the like, in order to open the case, would either separate the outer closure flaps from the inner closure flaps or simply cut off the entire top. In either situation, it is not generally possible to reclose that case to secure the articles as well as the original closure.

However, a need frequently exists for intercepting an article case of this type intermediate through its usual travel in commerce to open and gain access to the articles within the case and then subsequently reclose the case to secure the articles for further shipping and/or handling of the case. For example, its travel in commerce from the original manufacturer or other original packager to the retailer might include a distribution center; and it is frequently desirable to open these cases at the distribution center to place pricing or other information on the plurality of articles contained within the case. When this occurs, it is necessary to reclose the case so that the plurality of articles within the case remain secure for the remainder of the necessary shipping and/or handling.

At present, in order to open and reclose an article case of the type having inner and outer closure flaps, it is necessary to carefully separate the outer closure flaps from the inner closure flaps, breaking the adhesive bond but preferably not breaking the closure flaps themselves. Opening article cases in this way is itself a rather difficult task. After the articles are marked, if one wished to reclose the article case to firmly secure the articles, one would have to reglue the outer closure flaps to the inner closure flaps or otherwise tie the case closed. Such procedures are undesirably time consuming, costly and/or awkward.

It is known to provide article cases having special structures to permit one to open the article case at a time and place intermediate its usual travel in commerce to inspect the contents thereof and then to reclose the case. Such articles cases are shown for example in U.S. Pat. Nos. 2,712,894 and 3,142,432. However, in these known cases, the closure portions of the cases which are openable and reclosable are generally relatively loose as originally closed, and hence do not completely secure the articles during the initial stages of travel of the case in commerce. Also, these closures generally do not provide access to all of the articles within the case.

Thus, a need exists for an improved article case of the type described which can be originally closed to firmly secure the articles therein and then easily opened for access to all of the articles within the case and then easily reclosed to again firmly secure the articles therein so as to withstand further handling and/or shipping of that case in commerce.

SUMMARY OF THE INVENTION

It is a purpose of the present invention to provide a new and improved article case of the type described which overcomes the disadvantages of article cases as known heretofore.

This purpose of the present invention is achieved by providing, in an article case of the type having connected inner and outer closure flaps, a unique tearback tab feature formed into one or more of the outer closure flaps which is openable to gain access to at least a portion of all of the articles within the case and then reclosable to again firmly secure the articles therein.

In a preferred embodiment of the invention, the tearback tab is formed by weakened lines formed into that portion of an outer closure flap which overlies a free edge of an inner closure flap such that a base portion of the tearback tab immediately overlies at least some of the articles within the case, said base portion being connected to the remainder of the case, while an outer portion of the tearback tab overlies an inner closure flap. When the tearback tab or all of the tearback tabs are folded back, collectively they will expose at least a portion of all articles within the case. For example, articles within such a case are generally of the type such as boxes, cans or the like which have an upper surface lying in a horizontal plane just beneath the closure flaps. After all of the tearback tabs have been pulled back, the areas which were previously covered by the base portions of the tearback tabs will be exposed, as will at least a part of the upper surfaces of all articles. It is then convenient to apply tickets, stamps or any other information directly to the upper surfaces of the individual articles within the case.

Thereafter all of the tearback tabs are unfolded back to a flat state. Since the weakened lines have all been broken, naturally they cannot be secured as in their original state. However, in accordance with a feature of the present invention, a high integrity closure is achieved quite easily by simply tucking the outer portions of the tearback tabs under the inside closure flaps which they previously overlied. Since there will generally be a relatively small clearance between the lower surfaces of the inner closure flaps and the upper surfaces of the articles within the case, this outer portion of each tearback tab will fit snugly into that clearance and be retained there by its own stiffness and the frictional resistance offered by the surfaces above and below it, namely the lower surface of an inside closure flap and the upper surfaces of the articles contained therein.

The most frequently used article case is of the type having four closure flaps, generally a pair of smaller end closure flaps and a pair of longer side closure flaps, the former being on the inside and forming the inner closure flaps and the latter being on the outside and forming the outside closure flaps. In applying the present invention to this particular type of article case, the tearback tabs would be formed into each of the longer outside closure flaps. In cooperation therewith, each inside closure flap would have a reduced dimension from its connection to an end panel of the case to the free edge thereof, so as to expose between the opposed free edges thereof at least a part of the upper surfaces of all articles within the case. In cooperation therewith, a pair of tearback tabs could be provided on each of the longer outside closure flaps, each preferably to be torn back in a different direction, such that when both tearback tabs are completely pulled back, access would be gained to all articles within the case in the area between the opposed free edges of the inside closure flaps, without disturbing or disconnecting these inside closure flaps.

Each tearback tab takes up only a portion of the outer closure flap into which it is formed. Thus, when each tearback tab is separated and folded back, it removes only a portion of its outside closure flap and therefore does not require breaking the adhesive attachment between the remainder of the outside closure flap and the inside closure flaps to which it is attached. Thus, the inside closure flaps are still held securely in their original position by engagement with that remainder of the outside closure flaps. In addition, the articles are preferably arranged within the case such that only a portion of the upper part of each article is exposed, while the remainder of the article is secured in place by engagement of its sides with the sides of the other articles and by engagement of its top with the still secured inner closure flaps. Thus, even during maximum opening of the tearback tabs, exposing a portion of all articles, the individual articles are still held securely in place, and hence they are still held well in place after reclosing of the tearback tabs.

The principles of the present invention are also applicable to article cases of different sizes and shapes. In a given embodiment, only a single tearback tab may be needed, while in other embodiments a larger number of tearback tabs may be needed, in order to uncover all of the articles within the case.

The present invention also encompasses a blank for an article case which is so constructed that when fully assembled it will have the above-described openable and reclosable feature of the present invention.

Other objects and advantages of the present invention will become apparent from the detailed description to follow.

BRIEF DESCRIPTION OF THE DRAWING

There follows a detailed description of preferred embodiments of the present invention which are to be read together with the accompanying drawings wherein.

DETAILED DESCRIPTION OF THE PREFERRED EMBODIMENTS

Referring now to the figures, like elements are presented by like numerals throughout the several views.

Figure 2:
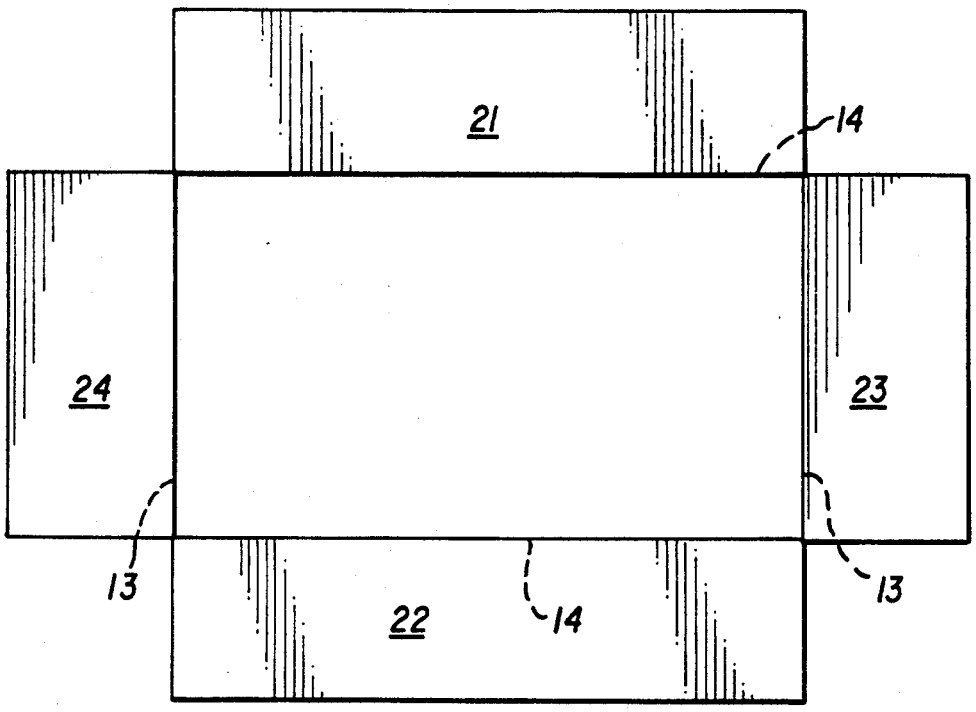
FIG. 2 (PRIOR ART)
FIGS. 1 and 2 illustrate a perspective and open top plan view, respectively, illustrating a typical prior art article case which does not include the features of the present invention.
Figure 1:
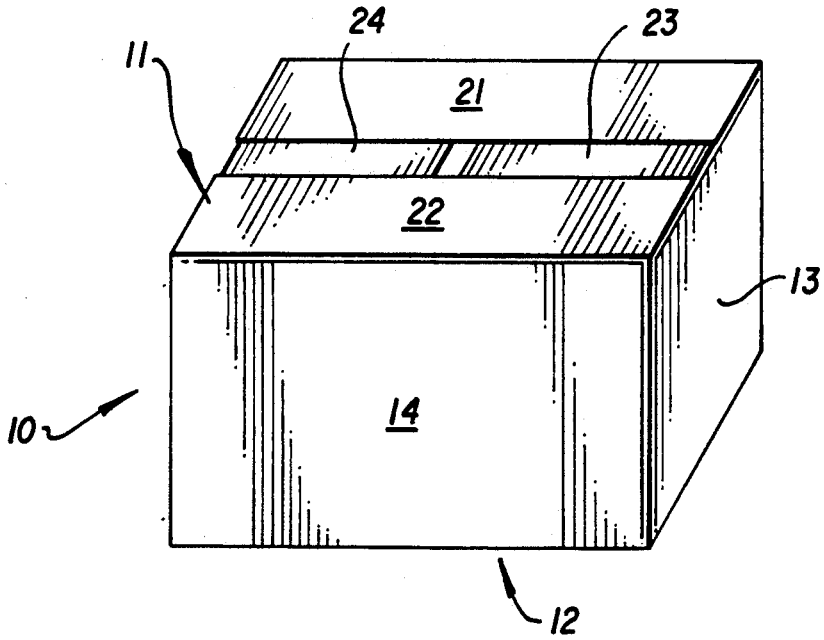
FIG. 1 (PRIOR ART)

FIG. 1 illustrates a conventional article case 10 having a top 1!, a bottom 12, opposed end panels 13 and opposed side panels 14. Referring to FIG. 2, which shows the conventional case of FIG. 1 with the top closure flaps opened and folded back, the top comprises a pair of opposed top side closure flaps 21 and 22 and a pair of opposed top end closure flaps 23 and 24. In these figures the case 10 is shown as being empty. Of course such cases can be used to contain any desired contents for shipping, handling, storage or the like.

Figure 3:
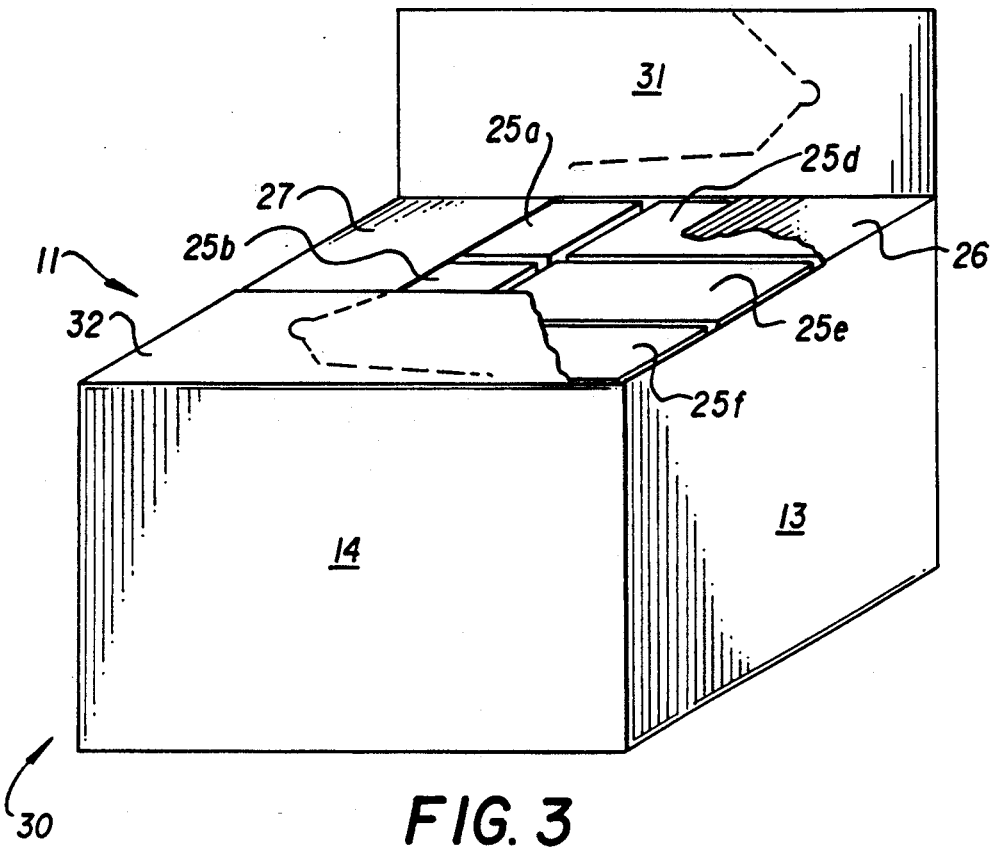
FIG. 3 is a perspective view cf an article case according to the present invention with one of the side closure flaps lifted and with portions broken away.

FIG. 3 shows an article case incorporating the features of the present invention. Although the present invention is suitable for use with a virtually unlimited range of contents, in this preferred arrangement the article case 30, as shown in FIGS. 3 through 6, the contents are six rectangular boxes, all having flat rectangular upper surfaces lying in a plane immediately beneath the plane of the top 11. These boxes are labeled **25*a* through 25*f*, wherein portions of each of them, with the exception of 25*c* are visible in FIG. 3**.

The article case 30 of FIG. 3 has been constructed to include the features of the present invention. The end panels, the side panels and the bottom are essentially the same as in the prior art. However, the top of case 30 is constructed to include the features of the present invention.

As discussed above, an essential purpose of the present invention is to provide an article case having portions formed in the top which can be easily opened to expose a portion of each and every article within the case, for example for ticketing each item with price or other information, and then subsequently reclosed so that the case can undergo further handling and/or shipping prior to the time that the articles contained therein are finally removed. This purpose is achieved by careful design of the top inside closure flaps and the top outside closure flaps. Referring to FIG. 3, the top inside closure flaps 26 and 27 should extend inwardly from the edges where they join end panels 13 only by a certain amount which will leave exposed portions of each of the containers **25*a* through 25*f* contained therein and concurrently cooperate with structure in the top side closure flaps 31 and 32 which will be closed over and attached to the top inside closure flaps 26 and 27**.

Figure 4:
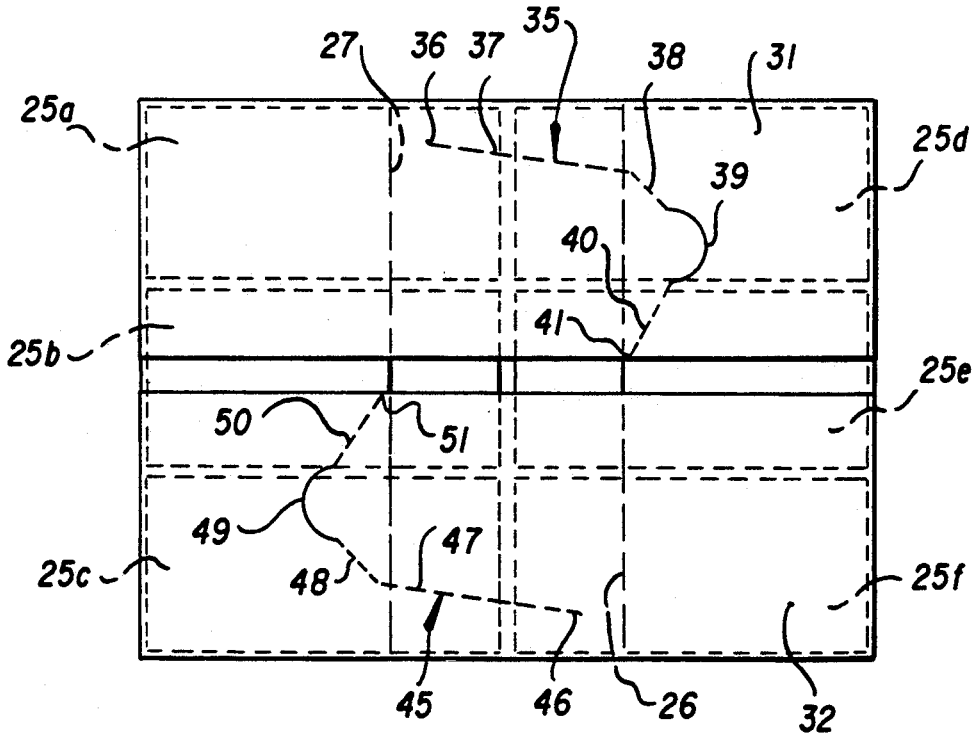
FIG. 4 is a top plan view of the article case of FIG. 3 with all closure flaps closed and with various interior parts represented by different types of lines.

FIG. 4 is a plan view of the case of FIG. 3 with both top side closure flaps 31 and 32 folded downwardly.

The six articles 25*a* through 25*f* are shown in dash-dot lines. Thereabove, two pale lines (which are dark where visible in the middle of the figure) illustrate the inner free edges of the top end inside closure flaps 26 and 27. The two top side closure flaps 31 and 32 are shown in dark solid lines.

Formed in these top side closure flaps 31 and 32 are respective openable and closable tearback tabs 35 and 45 which are shown in dark dotted lines, representing perforations which constitute one way to form weakened lines which define and form these tearback tabs 35 and 45. The side closure flaps 31 and 32 are glued to the end closure flaps 26 and 27 at any convenient location except in the area of the tearback tabs 35 and 45.

Referring to the upper half of FIG. 4, the tearback tab 35 starts at end point 36 and continues along generally longitudinal line 37, turning inwardly to form a shoulder 38 and then a thumb notch portion 39 followed by an opposite shoulder portion 40 which terminates at 41 where the line 40 intersects the inner, free edge of the closure flap 31. The tearback tab 45 is identical in construction to the tearback tab 35 except that it extends in the opposite direction. In this regard, elements 46 through 51 of the tearback tab 45 are essentially identical to the elements 36 through 41 of the tearback tab 35. Accordingly, only one of these tearback tabs will be further described in detail and it will be understood that the characteristics of the described tearback tab are equally applicable to the other tearback tab.

The tearback tab 35 can conveniently be described as containing two portions, a base portion which directly overlies upper parts of articles within the case and an outer portion which overlies the inside end closure flap 26. Thus, in FIG. 4 the base portion comprises that part of tearback tab 35 bounded on one side by longitudinal perforation line 37, on the opposite side by the free edge of closure flap 31, on the left by a fold line which starts at point 36 and runs generally towards the free edge of closure flap 31 and the free edge of closure flap 26 which runs beneath the tearback tab 35. The direction of the fold should be such that when the tearback tab 35 is pulled back it will expose at least a portion of all of the articles beneath its respective base portion, in this case articles 25*a*, 25*b*, 25*d* and 25*e*. Generally the case will be of a material such as a corrugated paperboard which has its own strength lines. In a typical corrugated box the strength lines would run perpendicular to the free edge of closure flap 31, in which case the fold line would be an essentially straight line from the point 36 directly down to the free edge of closure flap 31, perpendicular to that edge.

The outer portion of tearback tab 35 would include that portion in FIG. 4 to the right of the inside free edge of closure flap 26. This would include a wide portion limited by the shoulders 38 and 40 and the thumb notch 39. This outer portion must have a width sufficient to assure that upon reclosing (to be described below) this outer portion will tuck firmly and in a stable manner beneath the closure flap 26. It will be noted that the perforated line forming tearback tab 35 terminates at point 41 which intersects the free edge of closure flap 31. This convenient construction allows that portion of the free edge of closure flap 31 between point 41 and the above described fold line to be used as a side of the tearback tab 35.

The operation of the invention will now be described with reference to FIGS. 4 through 6.

Article case 30 is initially formed and closed for shipment in commerce or the like as shown in FIG. 4 with the top side outer closure flaps 31 and 32 closed down onto and adhered to the top end closure flaps 26 and 27 to substantially close the same. The term "substantially" recognizes that in practice there may be a small opening in the middle of the top because the four closure flaps do not necessarily touch each other.

This is the conventional form in which the article case of this type is generally shipped in commerce. The problem appreciated by the present invention, however, is that it is often necessary at intermediate points during its travel in commerce, that is intermediate between the original packager and the end user, for the article case to be opened, for example for marking the individual articles. In the past, opening such a case would have required essentially destroying the top closure and thus necessitate the use of additional adhesives to reclose the case. In fact, since such cases were not designed to be opened and reclosed, it was often impossible to open the case without destroying the top, thereafter requiring repair or replacement of the top closure prior to further shipment of the case in commerce.

In accordance with the present invention, when the case 30 reaches an intermediate point in its travel in commerce, whereat it is desired to open the case to expose at least a portion of each and every article therein, the features of the present invention are particularly advantageous.

Figure 5:
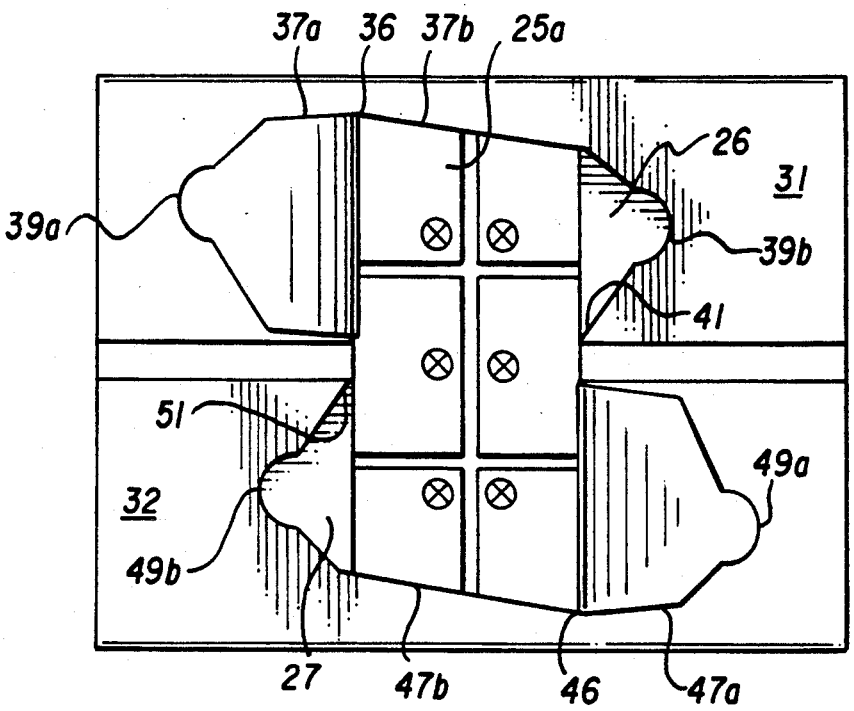
FIG. 5 is a top plan view similar to FIG. 4 but showing the invention during an intermediate stage in its operation.
Figure 6:
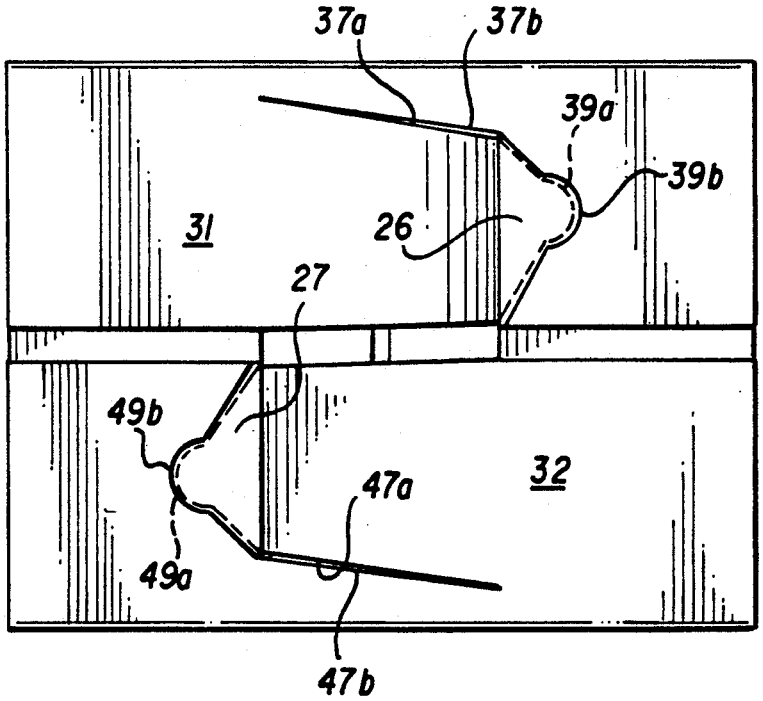
FIG. 6 is a top plan view similar to FIGS. 4 and 5 but showing the invention during a subsequent stage in its operation.

Referring to FIGS. 4 and 5, one would grasp the thumb notch 39 and carefully pull it back toward the above described fold line defined at one end by point 36. The thumb notch 39 can be constructed to facilitate grasping thereof. For example, it can be defined by a continuous arc-shaped cut, as shown in the drawings. In the alternative, the thumb notch may be defined by the same type of perforated line which defines the remainder of the tearback tab. In any event, after the thumb notch 39 has been grasped, it is pulled back, progressively completely separating the tearback tab 35 from the remainder of closure flap 31 first along shoulder portions 38 and 40 and then, at the top along longitudinal perforation line 37. The same procedure is performed with respect to tearback tab 45, starting at thumb notch 49 and pulling towards the right (as viewed in FIG. 4). FIG. 5 illustrates the next stage wherein both tearback tabs 35 and 45 have been pulled completely back. As is apparent therein, each of the six articles 25*a* through 25*f* now have a part of their respective upper surfaces fully exposed. Meanwhile, the end closure flaps 26 and 27 which are still secured in place, still attached to the remaining portions of side closure flaps 31 and 32, as well as those remaining portions of closure flaps 31 and 32, securely hold the articles in place in the case.

One would then apply the appropriate markings, tickets or the like, as represented by the circled "X's" in FIG. 5. In this figure, portions of the weakened line previously represented by the numerals 37–40 or 47–50 now include subscripts "a" and "b", wherein the subscript "a" represents the tearback tab side of the perforation while the subscript "b" represents the side of the perforation still lying flat within the closure flap 31 or 32.

After the articles have been marked, each of the tearback tabs 35 and 45 are folded back across the opening and the outer portions of the respective tearback tabs are then folded beneath the portions of the inside end closure flap which each previously overlied. Referring to FIG. 6, the outer portion of tearback tab 35 now appears as a dotted line because it is beneath the inside end closure flap 26. The same is true with respect to the outer portion of tearback tab 45.

Figure 7:
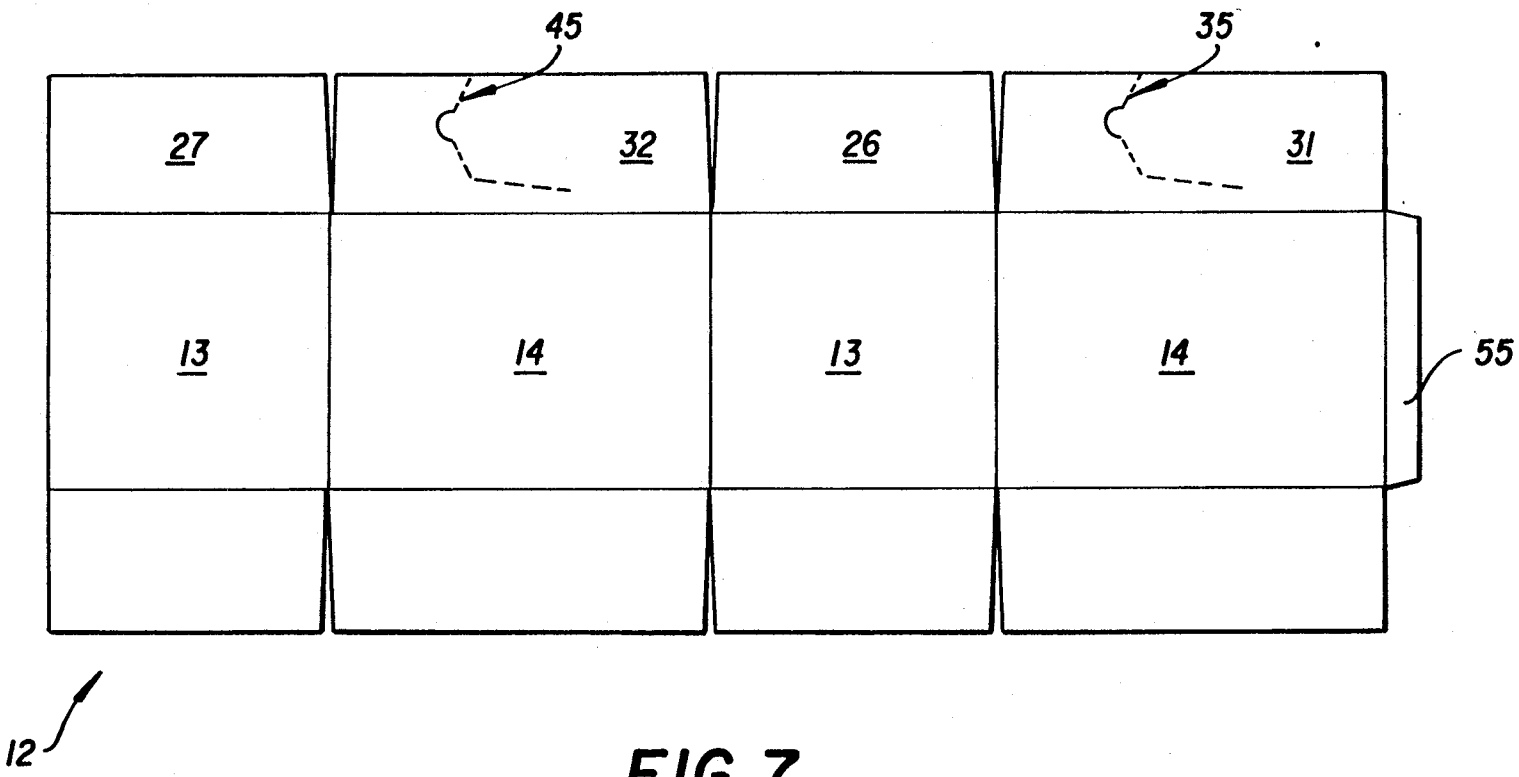
FIG. 7 illustrates a flat blank constructed to be arranged into an article case of the type shown in FIGS. 3 through 6.

FIG. 7 illustrates a blank which includes all of the necessary construction to be assembled into the article case 30 of the present invention. The blank is first formed by bringing the two opposite ends thereof together about an axis which is vertical as viewed in FIG. 7 until the tab 55 is attached to the end panel 13 appearing to the left hand side of the figure. The bottom is then formed in a conventional way by folding in the two bottom end closure flaps beneath end panel 13 and then folding in the two bottom side closure flaps beneath the side panels 14.

The top is then formed as already described above. After the contents have been placed in the case, the end inside closure flaps 26 and 27 are folded inwardly and then the side top closure flaps 31 and 32, with the tearback tabs 35 and 45 formed therein are then folded downwardly and adhered to the closure flaps 26 and 27, except in locations where the tearback tabs 35 and 45 overlie the closure flaps 26 or 27.

Figure 8:
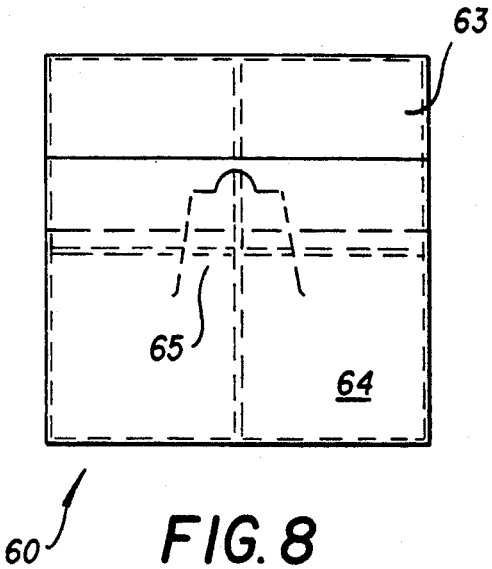
FIG. 8 is a top plan view of another embodiment of the present invention.
Figure 9:
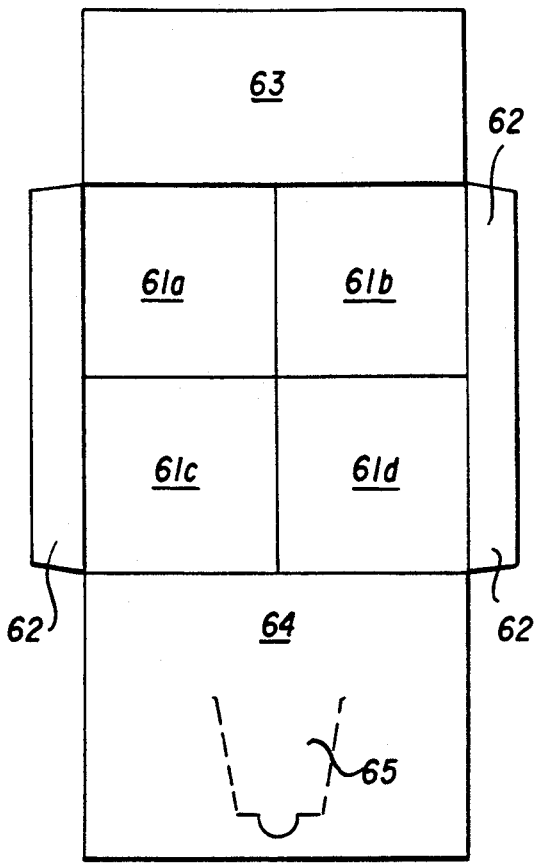
FIG. 9 is a top plan view similar to FIG. 8 but with the top closure flaps opened and folded back.
Figure 10:
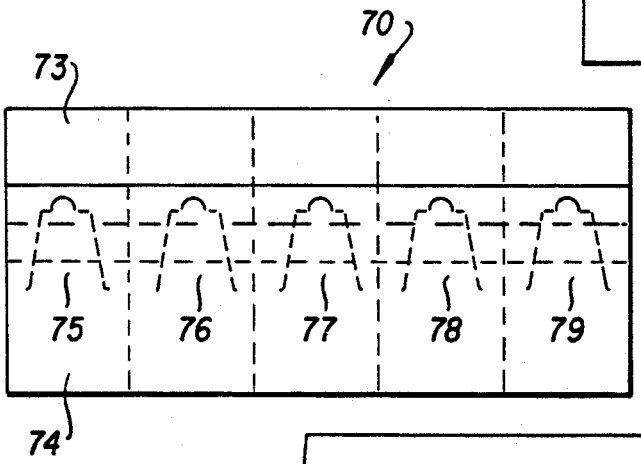
FIG. 10 is a top plan view of still another embodiment of the present invention.

It is to be understood that the features of the present invention are applicable to boxes of virtually any size or shape, provided that the goals of the present invention are met. FIGS. 8 through 10 illustrate the application of the principles of the present invention to boxes having shapes other than the preferred embodiment of FIGS. 3 through 7.

FIGS. 8 and 9 illustrate an article case construction requiring only a single tearback tab. As shown in FIG. 9, this case 60 carries four articles 61*a* through 61*d*. The case is first closed by a pair of narrow side closure flaps 62. One end closure flap 63 is then closed down over the turned in side closure flaps 62 and this covers a portion of articles 61*a* and 61*b*. Finally, the top outside closure flap 64 is closed down over the top, as shown in FIG. 8. In this construction, only a single tearback tab 65 is required. It will be understood that the tearback tab 65 is constructed similarly to the tearback tabs 35 and 45, although obviously differing in shape. Referring to FIG. 8, it will be seen that if the thumb notch portion of the tearback tab 65 is grasped and pulled back to a fold line formed by a line passing through the two ends of the line of perforations, a portion of each of the articles 61*a* through 61*d* will be exposed. Additionally, in accordance with the present invention, after the four articles have been marked, the portion of tearback tab 65 previously overlying the closure flap 63 could then be folded therebeneath to reclose the case for further shipment of the case in commerce.

Figure 11:
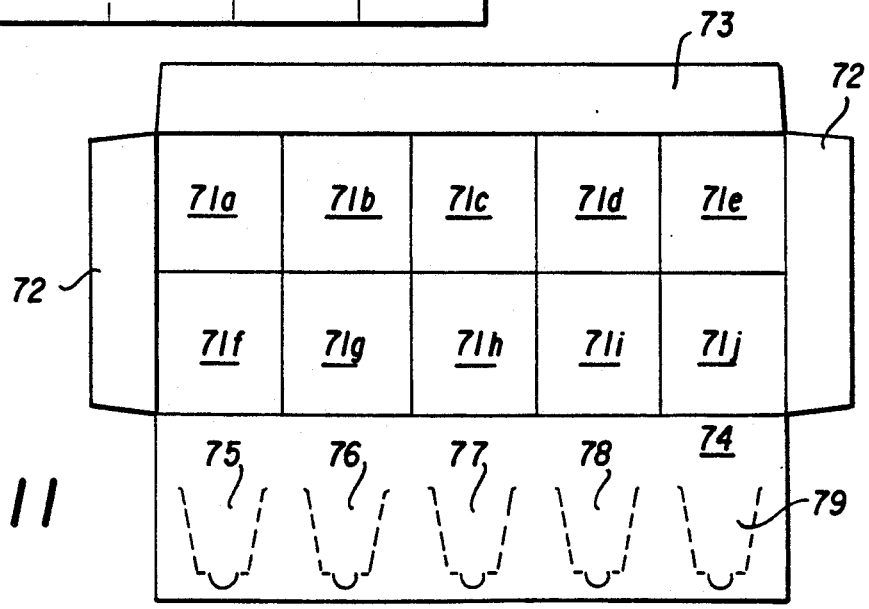
FIG. 11 is a top plan view similar to Figure 10 but with the top closure flaps opened and folded back.

Still another embodiment is shown in FIGS. 10 and 11, wherein a plurality of smaller openable and reclosable tearback tabs are utilized. Referring to FIG. 11, this particular article case 70 includes ten articles 71*a* through 71*j*. One would first fold in the two narrow end closure flaps 72 and then fold in the smaller side closure flap 73. Finally, the closure flap 74 would be folded over the other three closure flaps to form the outside closure flap. The closure flap 74 comprises a plurality of tearback tabs 75 through 79. It is to be understood that each of these tearback tabs has the same characteristics as the tearback tabs discussed earlier and in fact each is similar to the tearback tab 64 discussed with respect to FIGS. 8 and 9.

In practice, each of the tearback tabs 75 through 79 would then be opened in the same manner as discussed above, each exposing two of the articles contained therein. Each of the tearback tabs would then be folded beneath the free edge of closure flap 73 in order to reclose the container for further shipment in commerce.

Although the invention has been described in considerable detail with respect to preferred embodiments thereof, it will be apparent that the invention is capable of numerous modifications and variations, apparent to those skilled in the art, without departing from the spirit and scope of the invention.

I claim:

1. A reclosable, rectangular article case comprising a main portion which is adapted to receive a plurality of articles having upper surfaces and arranged so that the upper surfaces face upwardly, and a top which is connected to the main portion and normally covers the upper surfaces of the articles and is glued substantially closed thereover, said top including a pair of opposite end closure flaps folded in to form inside closure flaps and a pair of opposed side closure flaps folded in over the inside closure flaps to form outside closure flaps, the inside and outside closure flaps together covering substantially the entire top of the case, with the outside closure flaps covering and adhered to at least a portion of the inside closure flaps and with the articles in the case having at least a portion of their respective upper surfaces accessible through a space separating opposed free ends of the two inside closure flaps, and the outside closure flaps each having a separable, weakened line therein forming a tearback tab, said tearback tab crossing over a free edge of an inside closure flap to define a tearback tab base portion which immediately overlies at least one of said article upper surfaces and is permanently joined along at least one edge thereof to the remainder of the article case, and a tearback tab outer portion which immediately overlies an inside closure flap, wherein the articles within the case include at least a portion of their respective upper surfaces lying beneath a tearback tab base portion so that when the tearback tabs of the outside closure flaps have been separated along their said weakened lines and folded back, each moving its tearback tab outer portion and its tearback tab base portion back, said portions of the article upper surfaces are exposed for marking, and wherein, when the tearback tabs are unfolded to be flat and again overlie the articles, each is subsequently tuckable immediately beneath its respective insider closure flap to reclose the case.

2. A reclosable article case according to claim 1, said weakened lines comprising a perforation line cut into the top outside closure flaps.

3. A reclosable article case according to claim 2, wherein each top outside closure flap is connected to both of the top inside closure flaps by an adhesive at areas which exclude the areas immediately beneath the tearback tabs.

4. A reclosable article case according to claim 3, wherein said article case is made of cardboard.

5. A reclosable article case according to claim 4, wherein said weakened lines comprise a perforation line cut into the top outside closure flaps.

6. A reclosable article case according to claim 1, wherein each tearback tap is tapered inwardly from said one edge thereof toward the remote end of the tearback tab outer portion, and is substantially wide enough at a point within the outer portion to firmly tuck under its respective inside closure flap to reclose the case.

7. A reclosable article case according to claim 6, wherein the outermost end of the tearback tab includes a thumb notch portion to be grasped to facilitate separating the tearback tab along the weakened lines and moving the tearback tab back.

8. A blank adapted to form a reclosable article case of the type which receive a plurality of articles having upper surfaces which face upwardly, comprising:

four panels arranged side by side to form the sides and ends of the case; bottom closure flaps extending beneath the side and end panels for forming a bottom of the case and top closure flaps extending upwardly from the two side and two end panels to form the top of the case, said top closure flaps including a pair of end closure flaps and a pair of side closure flaps with the end closure flaps adapted to be folded to form inside closure flaps and the side closure flaps adapted to be folded onto the inside closure flaps to form outside closure flaps, all of the top closure flaps together when closed substantially covering the entire top of the case, the two outside top closure flaps each having separable, weakened lines therein forming tearback tabs, said tearback tabs positioned to cross over free edges of the inside closure flaps when the case is assembled to define tearback tab base portions which immediately overlie the upper surfaces of articles within the case and which are permanently joined along at least one edge thereof to the remainder of the case and tearback tab outer portions which immediately overlie an inside closure flap, wherein, when the case is assembled with articles contained therein, the tearback tabs can be separated along said weakened lines and pulled back to expose product therein and then unfolded to be generally flat and tucked immediately beneath its respective inside closure flap to reclose the case.

9. A blank according to claim 8, said weakened lines comprising a perforation line cut into the top outside closure flap.

10. A blank according to claim 9, wherein said article case is made of cardboard.

11. A blank according to claim 8, wherein each tearback tab is tapered inwardly from said one edge thereof towards the remote end of the tearback tab outer portion and is substantially wide enough at a point within the outer portion to firmly tuck under its respective inside closure flap.

12. A blank according to claim 11, wherein the outermost end of each tearback tab includes a thumb notch portion to be grasped to facilitate separating the tearback tab along the weakened lines and pulling it back.

* * * * *